United States Patent [19]

Zinn et al.

[11] Patent Number: 4,529,377

[45] Date of Patent: Jul. 16, 1985

[54] PULSE COMBUSTOR APPARATUS

[75] Inventors: Ben T. Zinn, Atlanta, Ga.; Nehemia Miller, Haifa, Israel; Brady R. Daniel, Stone Mountain, Ga.

[73] Assignee: Georgia Tech Research Institute, Atlanta, Ga.

[21] Appl. No.: 470,486

[22] Filed: Feb. 28, 1983

[51] Int. Cl.[3] ..... F27B 15/00; F27D 7/00; F23C 11/04

[52] U.S. Cl. ..... 432/58; 110/347; 431/1; 432/25

[58] Field of Search ..... 432/25, 58; 431/1; 122/15; 110/190, 191, 347

[56] References Cited

U.S. PATENT DOCUMENTS

| | | | |
|---|---|---|---|
| 2,839,046 | 6/1958 | Kamm | 431/1 |
| 4,111,158 | 9/1978 | Reh et al. | 432/58 |
| 4,259,928 | 4/1981 | Huber | 431/1 |
| 4,417,868 | 11/1983 | Putnam | 431/1 |

FOREIGN PATENT DOCUMENTS

| | | | |
|---|---|---|---|
| 707581 | 4/1965 | Canada | 431/1 |
| 909417 | 5/1980 | U.S.S.R. | 431/1 |

*Primary Examiner*—John J. Camby

*Attorney, Agent, or Firm*—Newton, Hopkins & Ormsby

[57] ABSTRACT

A pulse combustor apparatus including a combustor tube having open ends and containing at least one combustion zone where combustion of a fuel occurs and heat is released, resulting in the formation of a standing acoustic mode with nodes and anti-nodes in the tube. The combustion zone is located approximately half the distance between the acoustic pressure node and anti-node where the acoustic pressure oscillation lags the acoustic velocity oscillation by approximately one-quarter wavelength of the oscillation. Furthermore, the combustion air must flow towards the acoustic pressure anti-node. The fundamental principle relating to the occurrence of the pulsations in the combustor is the interaction between the combustion processes and both the non-zero acoustic velocity and acoustic pressure oscillations at the designated combustion zone location. In a preferred embodiment employing a vertical combustor tube, the combustion zone is located one quarter of the length of the tube away from the bottom of the combustor tube and a heat exchanger is located three quarters of the length of the combustor tube away from the bottom of the combustor tube.

35 Claims, 8 Drawing Figures

PULSE COMBUSTOR APPARATUS

BACKGROUND OF THE INVENTION

1. Field of the Invention

This invention relates to a pulse combustor apparatus that utilizes the excitation of sound waves to intensify combustion of a fuel, and further, to increase thermal efficiency, improve heat transfer, reduce pollutants formation and slagging. More particularly, this invention relates to a pulse combustor capable of burning either solid, liquid or gaseous fuels whereby the generated hot, pulsatile flow of combustion products can be used for varying applications such as steam raising for power generation, water heating, space heating, drying and so on.

2. Description of the Prior Art

In the majority of combustors developed to date, the combustion process occurs under steady state conditions; that is, the pressure in every location in the combustor remains approximately constant with time. The only unsteadiness observed in these combustors is that due to turbulence fluctuations. As a matter of fact, these devices are designed specifically to avoid the excitation of any pressure pulsations within the combustor.

As described in U.S. Pat. No. 4,164,210 to Hollowell, pulse combustion heater systems have been known for many years. In such conventional devices, the fuel and combustion air are admitted into a pulse-combustion chamber where they are ignited to produce an internal explosion. The pressure rise associated with the explosion results in the expulsion of the hot combustion products from the chamber, through a tail pipe into an exhaust decoupling or an expansion chamber. This results in the establishment of a negative pressure in the chamber. Consequently fresh air and fuel are drawn into the chamber through appropriate valves, whereupon the next ignition and explosion occurs, followed by closure of the valves until the next negative pressure occurs. Accordingly, once started, a self-perpetuating series of heat-releasing explosions are produced, with combustion air and fuel being ingested automatically and intermittently through appropriate air and inlet valves as needed.

The existing combustors that also burn fuels under pulsatory conditions differ from the present invention by utilizing different combustor configurations and different scientific principles for exciting the pulsations. Furthermore, these combustors were generally designed to burn either gaseous or liquid fuels. The known literature does not disclose the existence of any pulsating combustor that is capable of burning unpulverized solid fuels stably over a sustained period of time.

Prior pulse combustion heater systems are also known from the following U.S. Pat. Nos. 3,267,985 to Kitchen; 3,721,728 to Luetzelschwab; 4,241,723 to Kitchen; and 4,259,928 to Huber.

SUMMARY OF THE INVENTION

Accordingly, one object of this invention is provide a novel pulse combustor apparatus which utilizes the excitation of sound waves to intensify the combustion of a fuel, improve the heat transfer processes, and increase thermal efficiency.

Another object of this invention is to provide a novel pulse combustor apparatus which reduces slagging and the formation of pollutants.

Another object of this invention is to provide a novel pulse combustor apparatus which burns either solid, liquid or gaseous fuels with little excess air to generate hot, pulsatile flow of combustion products which can be used for such applications as steam raising for power generation, water heating, and drying. The use of little excess air by the apparatus of the invention increases the thermal efficiency of the system in which it is used.

Yet a further object of this invention is to provide a novel pulse combustor apparatus which when operated under fuel rich conditions, functions as a solid fuel gasifier.

Yet another object of this invention is to provide a novel pulse combustor apparatus in which combustion pulsations are excited based on the combustor configuration, the choice of magnitude and direction of the combustion air flow, the design and location of the fuel feed system, and the combustion zone location and configuration.

These and other objects are achieved according to the present invention by provision of a new and improved pulse combustor apparatus having combustion characteristics directly related to the excitation of the fundamental, longitudinal, acoustic mode, whereby combustion and heat transfer and other related processes consequently occur under pulsating conditions. This is achieved according to the invention by means of a pulse combustor apparatus including a combustor tube having open ends and containing at least one combustion zone where combustion of a fuel occurs and heat is released, inlet means for feeding the fuel to the combustion zone, wherein the heat released by the fuel combustion excites one of the natural, longitudinal acoustic modes of the combustion tube. Such a mode has pressure nodes at both ends of the combustor tube and anti-nodes inside the tube. In most applications, the fundamental mode that has one anti-node in the center of the combustor tube is excited. According to the invention, the combustion zone is located approximately half the distance between the acoustic pressure node and anti-node, where the acoustic pressure oscillation lags the acoustic velocity oscillation by approximately one quarter period of the acoustic oscillation.

In a preferred embodiment, the pulse combustor apparatus includes a vertical pulse combustor tube having open ends, wherein the combustion zone is located one quarter of the vertical tube's length from the bottom of the tube.

A further feature of the invention resides in the provision of means for removing heat from the combustor tube, such as a heat exchanger, wherein the heat exchanger is located at a distance of one quarter wavelength downstream of the location of the combustion zone where the acoustic pressure oscillation leads the acoustic velocity oscillation by one quarter period of the acoustic oscillation.

The key to the occurrence of the pulsations in the developed combustor is the interaction between the combustion process and both the non-zero acoustic velocity and acoustic pressure oscillations at the selected combustion zone location. In contrast, the operation of previously developed pulsating combustors, that were based upon either the Schmidt tube or the Helmholtz resonator principles, was based upon the interaction of the combustion process with the pressure oscillation only and not with the velocity oscillation and the combustion process in these devices was designed to occur at a location where pressure oscillations only are significant.

The combustor according to the invention operates either in a self aspirating or in a forced flow mode. Under either mode of operation, the heat release by the combustion process occurs at approximately half the distance between the acoustic pressure node and acoustic pressure anti-node where the acoustic pressure oscillation lags the acoustic velocity oscillation by approximately one quarter period of the acoustic oscillation.

The amplitude of pulsations in the combustor according to the invention are increased by removing heat from the combustion products at a distance of one quarter wavelength of the acoustic oscillation downstream of the location of the combustion zone. At this location, the acoustic pressure oscillation leads the acoustic velocity oscillation by one quarter period of the acoustic oscillation. In practice, this pulsations amplification effect is achieved by removing heat from the hot combustion products flow by the use of a heat exchanger that is centered around the above indicated location and whose length is somewhat shorter than one quarter wavelength of the excited acoustic oscillation.

When operating in the self aspirating mode, the pulsating combustor orientation can be vertical or at any angle which will allow a natural draft of the flow of combustion products out of the combustor and the flow of combustion air into the combustor. When operating in a forced mode, the combustor orientation can be vertical, horizontal or any other desired angle. In both cases the heat release and heat removal processes within the combustor must satisfy the previously specified conditions and other practical requirements (e.g., ash removal).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

FIG. *6a* is a schematic side view, partly in cross-section, of a single tube pulse combustor apparatus including a dryer section, utilizing gaseous fuel, according to the invention;

FIG. *6b* is a schematic side view, partly in cross-section, of a pulse combustor apparatus of the invention including a separate pulse combustor tube and a separate pulse dryer tube in communication with the pulse combustor tube; and FIG. *6c* is a schematic side view, partly in cross-section, of a pulse dryer design according to the invention utilizing a conventional non-pulsating combustor and a pulsating dryer.

DESCRIPTION OF THE PREFERRED EMBODIMENTS

Figure 1:
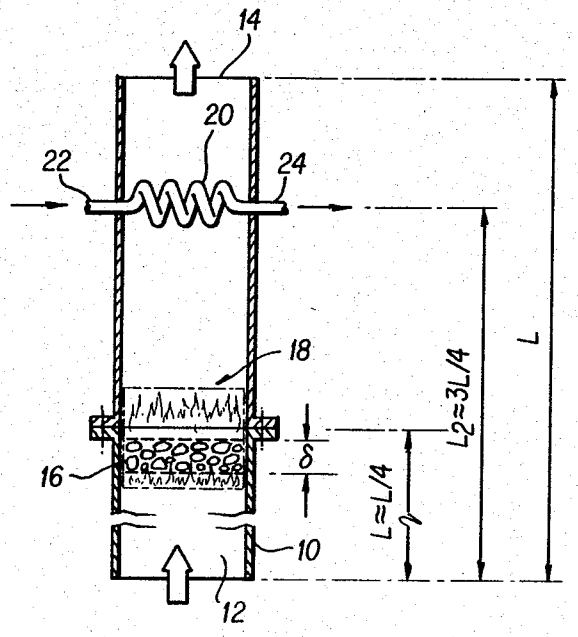
FIG. 1 is a schematic side view, partly in cross-section, of a self aspirating pulse combustor apparatus of the invention, wherein solid fuel is burned at location $L_1=L/4$ and heat removal occurs at location $L_2=3L/4$, wherein $L_1$ and $L_2$ refer to linear distances and L refers to the length of the combustor tube of the invention.

Referring now to the drawings, wherein like reference numerals designate identical corresponding parts through the several views, and more particularly to FIG. 1 thereof, the pulse combustor there shown includes a combustor tube 10 having open ends 12 and 14. Within the combustor tube 10 is a fuel bed 16, which upon burning defines a combustion zone 18 which includes the fuel bed 16 and extends downstream from the fuel bed 16 to include that section of the combustor tube 10 where combustion continues to take place. The combustion zone can also extend a short distance upstream of the fuel bed due to reverse flow caused by the pulsations. The center of the combustion zone 18 is located at a distance one quarter of the length of the combustor tube 10 from the open end 12. Above the combustion zone 18 is located a heat exchanger 20 which is located three quarters the length of the combustor tube 10 measured from the open end 12. The heat exchanger 20 has a cold water input end 22 and a hot water or steam output end 24.

During operation of the pulse combustor shown in FIG. 1, combustion air enters the combustor tube 10 via the opening 12 to promote combustion of the fuel provided in the fuel bed 16, resulting in the production of combustion products in the combustion zone 18. Heat released from the combustion process, as well as the combustion products thereof, flow upwardly past the heat exchanger 20, thereby heating cold water entering the heat exchanger 20 at the end 22 and resulting in the output of hot water or steam at the end 21. In the vertical combustor opened at both ends shown in FIG. 1, the combustion process is designed to occur at a distance of one quarter of the length of the combustor tube from the bottom of the tube 12. When combustion and heat release occur at this location, pressure pulsations are excited in the combustor due to the interaction between the combustion process and the fundamental longitudinal, acoustic mode of the combustor.

According to the invention, the amplitude of pulsations in the combustor tube 10 can be increased by removing heat from the generated combustion products at a distance of one quarter wavelength downstream of the location of the combustion zone. As shown in FIG. 1, the heat exchanger 20 is therefore located three quarters of the length of the combustor tube 10 away from the bottom open end 12. At this location, the acoustic pressure oscillation leads the acoustic velocity oscillation by one quarter period of the oscillation. In practice, the resulting pulsations amplification effect is achieved by removing heat from the hot combustion products flow by the use of a heat exchanger that is centered around the indicated location and whose length is somewhat less than a quarter wavelength of the excited acoustic oscillation, as shown in FIG. 1.

When operating in the self aspirating mode, the combustor orientation can be vertical or any other orientation which will allow a natural draft for the flow of combustion products out of the combustor and for the flow of air into the combustor. When operating in a forced mode, the combustor orientation can be vertical, horizontal or any other desired angle, as long as the heat release and removal processes within the combustor satisfy the above noted conditions and other practical requirements, such as for example, ash removal.

Figure 2:
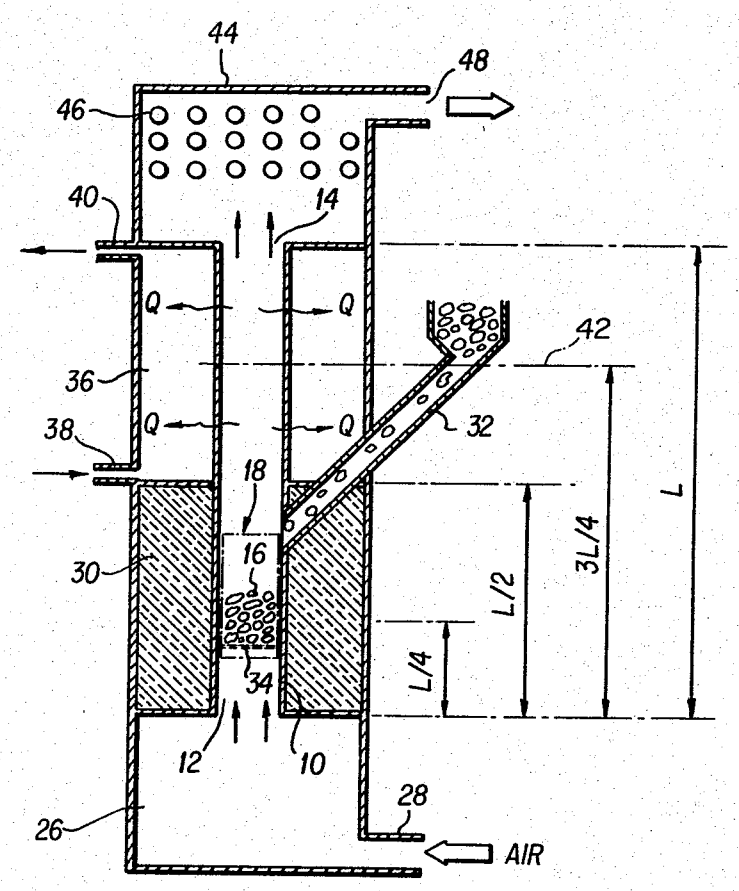
FIG. 2 is a schematic side view, partly in cross-section, of a forced flow pulse combustor apparatus of the invention including top and bottom acoustic decoupling chambers and heat exchangers inside the top acoustic decoupling chamber.

Under forced flow operation shown in FIG. 2, fresh air is supplied to the combustor tube 10 through an acoustic decoupler chamber 26 that is attached to the bottom of the combustor tube 10. The decoupler chamber 26 is designed to provide a means for supplying forced air flow to the combustor tube 10 without significantly altering the acoustic boundary conditions at the bottom of the combustor tube 10, thus maintaining the required "open end" boundary condition required for excitation of the pulsations. As shown in FIG. 2, the decoupling chamber 26 is provided with an air intake 28 which supplies combustion air to the bottom opening 12 of the combustor tube 10. Surrounding the lower half of the combustor tube 10, which includes the fuel bed 16 and the combustion zone 18 is an insulation jacket 30. A fuel feed mechanism 32 supplies fuel to the fuel bed which is supported by a grid 34. Surrounding the upper half of the combustor tube 10 is a water heat exchanger 36 having a water inlet 38 and a steam or heated water outlet 40. The center line 42 of the heat exchanger 36 is located at a distance three quarters of the length of the combustor tube 10 away from the combustion air inlet 12. An exhaust end acoustic decoupler 44 is also attached to the top of the combustor tube 10. The decoupler 44 houses additional heat exchangers 46 for removing thermal energy from the hot combustion products that leave the combustor tube 10. In addition, the exhaust end decoupler 44 can be used, if necessary, for housing air pollution control equipment (not shown). The decoupler 44, like the decoupler 26, is designed to assure that the acoustic boundary condition at the exhaust end 14 of the combustor tube 10 is not significantly altered from the required "open end" condition.

When burning gaseous or liquid fuels, the fuel supply system and flame holders (not shown), if such are utilized, should be designed to avoid any destructive acoustic interference between any acoustic waves that might be excited in the fuel supply system and the combustor pulsations. Furthermore, acoustic losses associated with the fuel supply system and flame holders should be minimized.

When burning coal, wood or any solid fuel, the fuel is burned in the combustion zone 18 which includes the fuel bed 16. Combustion air enters the fuel bed 16 and combustion zone 18 through metal grid 34 that supports the fuel bed 16. As shown in FIG. 2, the solid fuel is supplied to the bed 16 through the fuel feed system that penetrates to the wall of combustor tube 10 above the bed 16. For large diameter combustors, more than one fuel feed system may be utilized. In any event, the fuel feed system must be designed to assure a continuous and steady fuel feed rate to provide a uniform distribution of the solid fuel in the bed and to minimize attenuation of the acoustic pulsations in the combustor. If the utilized fuel shows a tendency to agglomerate, which would reduce the air flow rate through the combustion bed 16 to unacceptable levels, mechanical devices (not shown) are to be used to prevent fuel agglomeration and to improve the air flow characteristics of the combustor tube 10.

When operating in a forced flow mode and at a predetermined fuel feed rate, the intensity of the combustion process may be controlled by controlling the velocity of the steady air flow. Increasing the air flow velocity, increases the amplitude of the acoustic pulsations, the combustion intensity and the heat transfer processes.

$NO_x$ formation in the combustor may be further reduced by lowering the temperature of the combustion zone with the aid of water tubes that pass through the combustion bed and/or the surrounding wall. In addition, $SO_x$ formation may be reduced by the addition of dolomite and/or lime to the bed.

The developed combustor exhibits maximum combustion efficiency when operating near stoichiometric conditions. Consequently, devices utilizing the developed combustor possess higher thermal efficiencies than those utilizing conventional combustors because the pulsating combustor requires less excess air than conventional combustors to obtain optimum combustion efficiency. The heat release rate may be controlled by independently controlling the air flow rate and the fuel feed rate.

The following are the main advantages of the developed combustor; (1) it has a relatively simple design; (2) it is characterized by a very high combustion intensity that allows the utilization of a smaller combustor volume for a given energy release rate (i.e., Btu/hr); (3) it results in practically complete combustion, while producing insignificant amounts of carbon monoxide and soot; (4) it produces small amounts of nitrogen oxides; (5) it offers the possibilities of cooling the combustion bed and/or adding lime and dolomite to the bed to further reduce nitrogen and sulfur oxides formation; (6) it requires less excess air for optimum operation at the maximum combustion efficiency, thus resulting in higher thermal efficiencies; (7) the presence of acoustic oscillations in the combustor results in improved convective heating of the heat transfer surfaces, such that smaller heat transfer surfaces are required for the transfer of a given amount of heat; (8) it can burn unpulverized coal; (9) it can operate either in a self aspirating or a forced flow mode; (10) the presence of acoustic oscillations results in a scrubbing-like motion along the walls of the combustor and heat exchange surfaces which reduces slagging and keeps heat transfer surfaces clean; and (11) it can be designed to burn gaseous, liquid or solid fuels, including wood with high moisture content.

Figure 3:
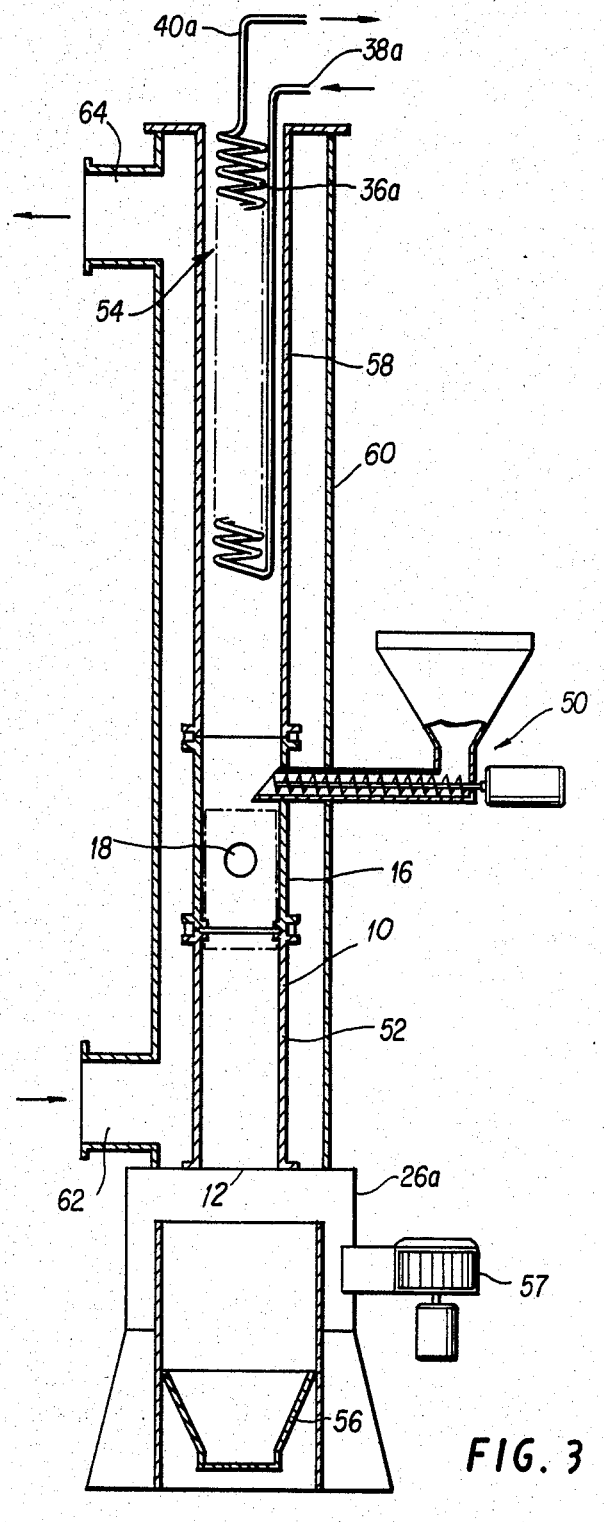
FIG. 3 is a schematic side view, partly in cross section, of a pulse combustor apparatus of the invention designed for space and water heating applications.

In the following disclosure, a number of applications of the developed pulsating combustor are described. In FIG. 3, its application in simultaneous air and water heating or steam raising using unpulverized solid fuel in a forced air mode of operation is shown. Unpulverized solid fuel (e.g., unpulverized coal, wood chips, waste materials, etc.) is introduced from a hopper via an auger type feed system (50) into the combustion bed 16 where it is burned in a pulsating mode of combustion, producing hot combustion products that flow upwards. Combustion air is supplied to the system by air fan 57 attached to an acoustic decoupler chamber **26*a* which supplies combustion air to the bottom opening 12 of the combustor tube 10. In the application shown in FIG. 3, the acoustic decoupler houses an ash and refuse collector 56**. Ash and combustion refuse material can be easily removed from the lower decoupling chamber either automatically or manually.

The combustion zone 18, including the fuel bed 16, is located one-quarter of the length L of the combustor tube 10 from the bottom open end 12. The air to be heated passes through the annular space between the wall of the combustor tube 10 and the insulated outer wall 60. The air to be heated enters the annular space at the air inlet 62 and exits at air outlet 64. The air is heated by the hot wall of the combustor tube 10. The upper section of the tube contains a water heat exchanger 36*a*. Water enters this heat exchanger through port 38*a* and it leaves as hot water or steam through port 40*a*. The water is heated by the flow of the hot combustion products over the heat exchange surfaces. This convective heat transfer is enhanced by the presence of pulsation in the flow and the cooling of the exhaust products in the upper half of the tube results in further amplification of the pulsation.

Figure 4:
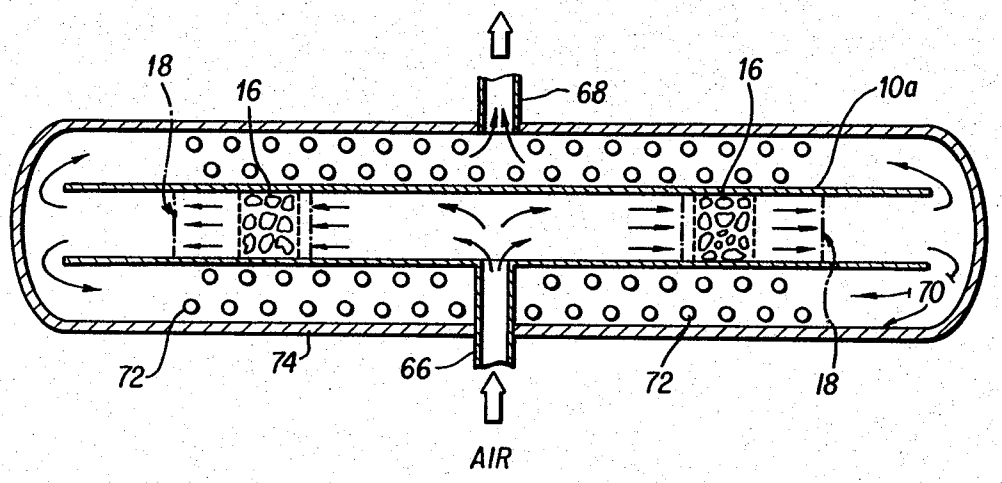
FIG. 4 is a schematic side view, partly in cross-section, of a modified, dual pulse combustor apparatus of the invention for water and/or air heating applications.

In FIG. 4, a dual pulsating combustor for water heating or steam raising is shown. In this application, the combustion air is supplied to an inner combustor tube 10*a* wherein combustion occurs. Combustion air enters the combustor tube 10*a* through air inlet port 66 and the combustion products are exhausted through an exhaust port 68 at the center of an outer tube 70. The combustion air inlet port 66 and the exhaust port 68 are located at positions where the acoustic pressure amplitudes are near zero, a condition that minimizes acoustic energy losses that attenuate the pulsations. The inner combustor tube 10*a* incorporates two combustion zones 18, each of which includes a combustion bed 16. The two combustion zones are located at a distance of approximately one-quarter of the length of the inner combustor tube 10*a* from the combustion air inlet port 66. The heat exchanger tubes 72 for air or water heating or steam raising are placed in the annular space between the inner combustor tube 10*a* and the outer tube 70 where they are heated by hot combustion products leaving the system. To minimize heat losses, an insulation layer or a water jacket 74 enclose the outer tube 70.

The application shown in FIG. 4 differs from those in FIGS. 2 and 3 by the fact that hard wall acoustic boundary conditions and not open end acoustic boundary conditions are satisfied by the acoustic oscillations at both ends of the combustor. Consequently, to achieve pulsating combustion operation, the steady flow must follow the pathway shown in FIG. 4 and the combustion zones and heat exchanger must be placed in the indicated locations.

The dual pulsating combustor does not have to be oriented horizontally and it can be shaped or bent into different configurations provided that the required hard wall acoustic boundary conditions and necessary steady flow directions are maintained.

The steady flow directions for the outer tube 70, where heat is removed from flow, are such that cooling of the exhaust products in that section further enhances the pulsations.

Figure 5:
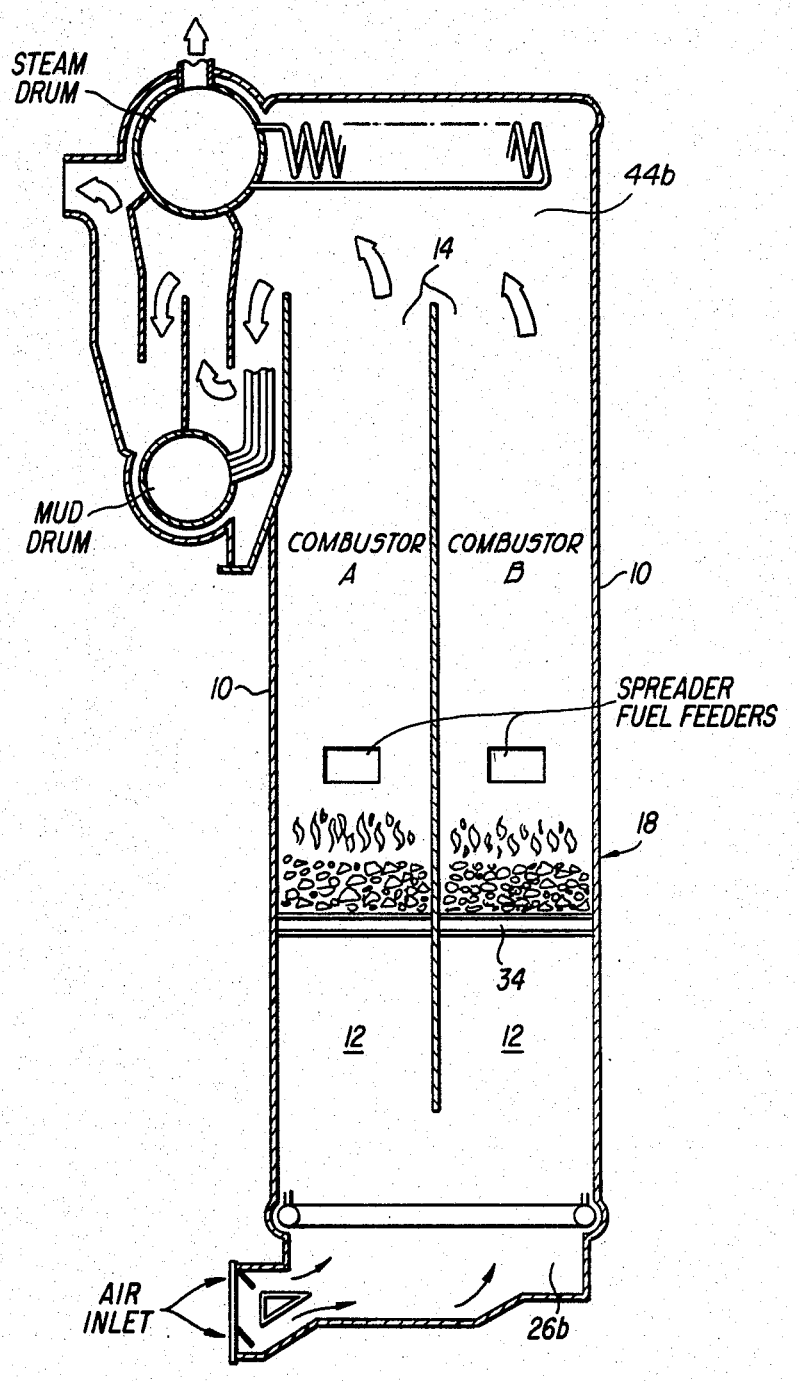
FIG. 5 is a schematic side view, partly in cross-section, of a modular pulse combustor apparatus of the invention, including parallel application of a number of pulse combustor tubes for steam raising, wherein the pulse combustor tubes are provided with common top and bottom acoustic decouplers.

In FIG. 5, a modular use of the developed pulse combustor apparatus is illustrated. In this example, parallel operation of two pulsating combustors, combustor A and combustor B, is employed to achieve increased thermal output for steam raising. Each of these pulse combustors is similar to the basic pulse combustor shown in FIGS. 2 and 3. However, in the modular application these combustors have common decoupling chambers 26*b* and 44*b* on bottom and top of the apparatus, respectively. The bottom decoupling chamber 26*b* provides the combustion air to the combustor tubes 10. The upper decoupling chamber 44*b* houses the heat exchangers and associated equipment for steam raising. While FIG. 5 demonstrates an application that utilizes only two combustors, additional pulse combustors can be added to achieve a higher thermal output.

Figure 6C:
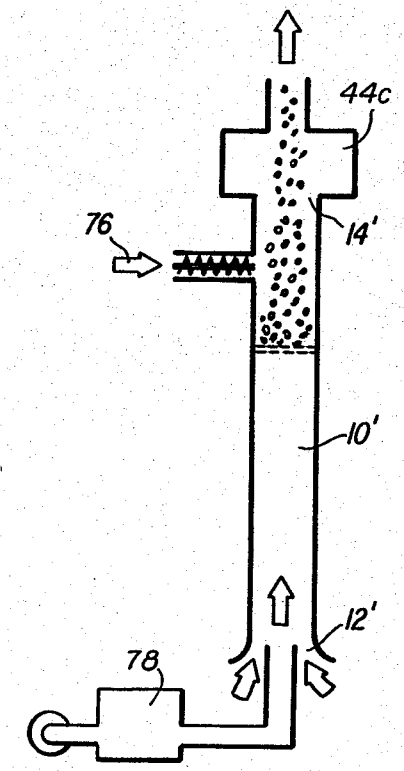
Figure 6B:
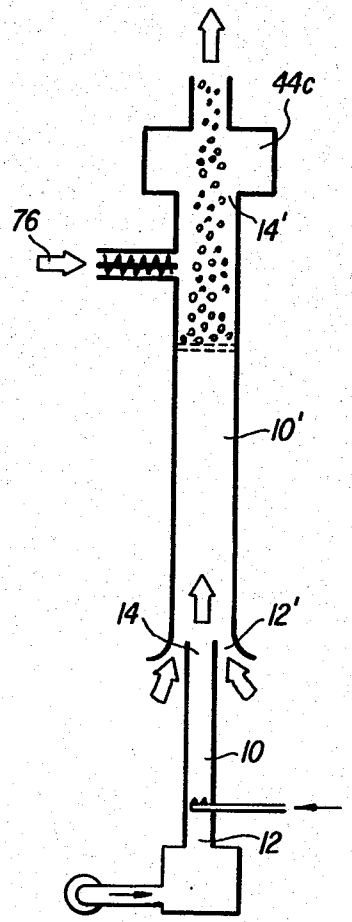
Figure 6A:
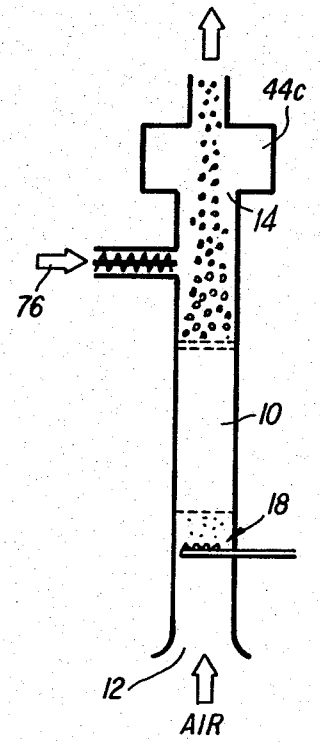

In FIGS. 6*a*, 6*b* and 6*c*, three different applications of pulse combustion to drying are illustrated. In FIG. 6*a*, gaseous or liquid fuel is burned near the center of the lower half of the vertical combustor tube which serves as a dryer. Wet material 76 is supplied and dried near the center of the upper half of the tube 10. Pulsations occur because of the chosen locations of heat addition due to combustion and heat removal due to drying. Not shown in FIG. 6*a* is an exhaust fan that is located between the upper decoupler chamber 44*c* and a cyclone separator (not shown) where the solids and gases in the two phase flow are separated. Thus, the lower end 12 remains open and only an upper decoupling chamber 44*c* is used to assure that an open end acoustic boundary condition is satisfied at the upper end 14 of the dryer. The presence of pulsations in the flow will enhance the drying process because of the associated acoustic oscillations which mechanically vibrate the drying material and intensify the heat transfer process that is used to vaporize the water contents of the material.

The dryer shown in FIG. 6*b* consists of two sections. The lower section is a pulse combustor tube 10 and the upper section is a pulse dryer tube 10'. Pulsations occur in the lower tube 10 because combustion and heat addition occur in the center of the lower half of the combustor tube 10. Pulsations occur in the upper dryer tube 10' because heat is removed from the hot combustion products in the center of the upper half of the dryer tube 10'. The lower pulse combustor has a diameter smaller than the upper pulse dryer and the system operates as an ejector when hot exhaust products of the lower pulse combustor entrain outside air as they enter the upper dryer tube 10' through the bottom opening 12'. This results in a higher flow rate and cooler (than the exhaust products of the lower combustor) temperatures in the upper dryer tube 10' because the hot exhaust products of the lower combustor tube 10 are diluted with the much cooler outside air.

Finally, the dryer configuration shown in FIG. 6*c* utilizes a conventional, nonpulsating combustor 78 on the bottom and a pulse dryer tube 10' on top. Again, as in the dryer shown in FIG. 6*b*, pulsations occur in the drying tube 10' because heat is removed from the hot combustion products by the drying process near the center of the upper half of the dryer tube 10'. As in FIG. 6*b* outside air is ingested by entrainment and the rate of drying is intensified by the presence of acoustic oscillations that mechanically vibrate the drying materials as well as intensify the heat transfer process.

Recapitulating, the presence of pulsations in the developed pulse combustor apparatus and related devices results in higher combustion intensity and improved heat transfer processes compared with conventional combustors. Consequently, the developed combustor requires a smaller combustion volume for a given energy release rate and less surface area is required for the transfer of a given amount of heat. In addition, the presence of pulsations in the combustor results in high combustion efficiency, reduced pollutants formation and reduced slagging. Finally, since optimum performance of the developed combustor occurs near stoichiometric fuel/air ratio, this combustor prossesses high thermal efficiency, indicating that a large portion of the burned fuel energy is converted to useful energy.

The pulse combustor of the invention, and associated applications, derive their advantages from the excitation of one of the natural acoustic modes of the combustor. To achieve the desired excitation, it is critical that the combustion and heat removal processes occur at the indicated locations on the acoustic wave structure. Furthermore, it needs to be emphasized that while many of the examples discussed herein described applications involving the combustion of solid fuels, similar pulsating combustors could also be developed by burning gaseous or liquid fuels, as long as the combustion heat release takes place at the specified location and the steady combustion air flow maintains the indicated direction.

Specific features of the invention deemed particularly noteworthy are:

a pulsating combustor whose operation depends upon the interaction between the combustion process and both the acoustic velocity oscillation and the acoustic pressure oscillation;

cooling of the combustion products near the center of the upper half of the combustor for water heating, steam raising and other applications; cooling the combustion products at this location results in further amplification of the pulsations;

the operation of the combustor in a forced flow mode with independent controls for the air flow and the fuel supply rate;

the incorporation of decoupling chambers on the top and bottom of the developed combustor;

the ability to continuously burn unpulverized coal, wood chips, waste material, etc. in a combustion bed in a pulsating mode of combustion;

the hot water heater design shown in FIG. 4;

the use in parallel of a number of pulsating combustors with common top and bottom decoupling chambers (see FIG. 5) for the purpose of increasing the thermal output; and the utilization of the developed pulsating combustor in various drying applications utilizing the designs shown in FIG. 6.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An acoustic velocity and acoustic pressure pulsating combustor apparatus comprising:

a combustor tube having continuously open ends and containing at least one combustion zone where continuous combustion of a fuel occurs and heat is released to excite a standing acoustic wave in the combustor tube having at least one acoustic pressure node and at least one acoustic pressure anti-node;

inlet means for feeding fuel to said combustion zone; means for supplying combustion air to said tube without significantly attenuating the amplitude of said standing acoustic wave; and said at least one combustion zone being located approximately half the distance between the acoustic pressure node and the acoustic pressure anti-node where the acoustic pressure oscillation lags the acoustic velocity oscillation by approximately one quarter period of the acoustic oscillation so that the combustion zone is subjected to pulsations both of acoustic pressure and of acoustic velocity and steady flow of combustion air is directed towards the acoustic pressure anti-node located downstream of the combustion zone.

2. A pulse combustor apparatus according to claim 1, further comprising:

said tube being a vertical combustion tube having open opposed ends; and said combustion zone located one quarter of the length of the combustor tube from the bottom of the tube.

3. A pulse combustor apparatus according to claim 1, further comprising:

means for amplifying the amplitude of pulsations by removing heat from said combustion tube, said means for amplifying being located at a distance of one-quarter wavelength of the acoustic oscillation downstream of the location of the combustion zone where the acoustic pressure oscillation leads the acoustic velocity oscillation by one-quarter period of the acoustic oscillation.

4. A pulse combustor apparatus according to claim 3, wherein said means for amplifying comprises:

a heat exchanger having a length equal to or less than one-quarter wavelength of the excited acoustic oscillation.

5. A pulse combustor apparatus according to claim 1, wherein said means for supplying combustion air comprises:

a first decoupling chamber attached to that end of the combustor tube upstream of the combustion zone to assure open end acoustic boudary conditions at said one end of the combustion tube and for supplying forced air flow into the tube.

6. A pulse combustor according to claim 5, comprising:

a second decoupling chamber at the other end of said tube downstream of the combustion zone to assure open end acoustic boundary conditions at said other end of the tube and for housing heat exchangers for removing thermal energy from the combustion products leaving said tube.

7. A pulse combustor apparatus according to claim 3, wherein said means for supplying combustion air comprises:

a first decoupling chamber attached to that end of the combustion tube upstream of the combustion zone to assure open end acoustic boudary conditions at said one end of the combustor tube and for supplying forced air flow into the tube.

8. A pulse combustor according to claim 7, comprising:

a second decoupling chamber at the other end of said tube downstream of the combustion zone to assure open end acoustic boundary conditions at said other end of the tube and for housing heat exchangers for removing thermal energy from the combustion products leaving said tube.

9. A pulse combustor apparatus according to claim 4, wherein said means for supplying combustion air comprises:

a first decoupling chamber attached to that end of the combustion tube upstream of the combustion zone to assure open end acoustic boundary conditions at said one end of the combustor tube and for supplying forced air flow into the tube.

10. A pulse combustor according to claim 9, comprising:

a second decoupling chamber at the other end of said tube downstream of the combustion zone to assure open end acoustic boundary conditions at said other end of the tube and for removing thermal energy from the combustion products leaving said tube and for housing air pollution control equipment.

11. A pulse combustor apparatus according to claim 2, further comprising:

said tube having an inner tube wall and an insulated outer wall defining a heating space location therebetween; and a water heat exchanger located in an upper half of the tube.

12. A pulse combustor apparatus according to claim 1, comprising:

cooling means coupling said combustion zone for controlling the temperature thereof to minimize formation of nitrogen oxides.

13. A pulse combustor apparatus according to claim 1, comprising:

a material selected from the group consisting of dolomite and lime added to said combustion zone to reduce $SO_x$ formation.

14. A pulse combustor apparatus according to claim 1, comprising:

said combustor tube including an air inlet located centrally in said tube;

a pair of combustion zones disposed on opposite sides of said air inlet midway between the opposed ends of the tube and the inlet, respectively;

an outer tube surrounding said inner tube and having an exhaust outlet, said air inlet including a conduit through said outer tube and communicating with said combustor tube;

said outer tube completely enclosing said combustor tube except for said exhaust outlet and said air inlet conduit;

a heat exchanger disposed between said outer tube and said combustor tube; and said exhaust outlet located centrally relative to said combustor tube.

15. A pulse combustor apparatus according to claim 1, comprising:

plural parallel arranged combustor tubes each including a respective combustion zone; and common input and output acoustic decoupling chambers respectively coupling opposed ends of said plural combustion tubes.

16. A pulse combustor apparatus according to claim 15, comprising:

at least one heat exchanger disposed in the output acoustic decoupling chamber.

17. A pulse combustor apparatus according to claim 3, wherein said heat removing means comprises a wet material to be dried supplied to said combustor tube midway the upper half of said tube.

18. A pulse combustor apparatus according to claim 2, further comprising:

a pulsating drying tube disposed above said combustor tube and in communication therewith; and a heat removal means coupled to the center of the upper half of said dryer tube for removing heat from said drying tube.

19. A pulse combustor apparatus according to claim 18, comprising:

said drying tube having a cross-sectional area larger than that of said combustor tube.

20. A pulsating dryer adapted for removing heat from combustion products produced by combustion of a fuel, comprising:

a drying tube having two open ends, one end of which receives said combustion products and the other end of which exhausts said combustion products; and heat removal means for removing heat from said drying tube, said heat removal means coupling said drying tube at a location three fourths the length of said drying tube away from the end of said drying tube receiving said combustion products.

21. A pulse combustor according to claim 6 comprising air pollution control equipment positioned in said second decoupling chamber.

22. An improved combustor apparatus comprising:

a combustor tube having a length L and having open opposite ends so as to support natural longitudinal acoustic modes of oscillation, means for admitting combustion air into said tube while allowing said natural longitudinal modes of acoustic oscillation to be supported;

means for defining at least one combustion zone within said tube at a location therein which will excite one natural mode of oscillation which subjects said combustion zone both to acoustic pressure pulsation and acoustic velocity pulsations; and means for continuously supplying fuel to said combustion zone to generate heat at said location and excite one natural mode of oscillation;

said location being disposed within said tube substantially one half the distance between an acoustic pressure node and an acoustic pressure anti-node produced by said one natural mode of oscillation where the out of phase acoustic pressure oscillations and acoustic velocity oscillations both oscillate between finite values to produce pulsations of acoustic velocity and of acoustic pressure within said combustion zone.

23. An improved combustor apparatus as defined in claim 22 wherein said one natural mode of oscillation is the fundamental mode of oscillation.

24. An improved combustor apparatus as defined in claim 23 wherein said means for admitting combustion air is one end of said tube defining an open end acoustic boundary condition at said one end of the tube and said location of the combustion zone is approximately L/4 from said one end of the tube.

25. An improved combustor apparatus as defined in claim 23 wherein said means for admitting combustion air communicates with the central region of said tube and said location of the combustion zone is approximately L/4 from such means.

26. An improved combustor apparatus as defined in claim 22 wherein said means for admitting combustion air is one end of said tube defining an open end acoustic boundary condition thereat.

27. An improved combustor as defined in claim 22 wherein said means for admitting combustion air communicates with the central region of said tube where acoustic pressure amplitudes are near zero.

28. An improved combustor as defined in claim 22 including means located downstream of said combustion zone for cooling said combustion products at a location which increases the amplitudes of said acoustic pressure and acoustic velocity oscillations within said combustion zone.

29. An improved combustor apparatus for continuously burning fuel while subjecting the burning fuel to acoustic pressure and to acoustic velocity pulsations which increase the rate of combustion and allow the use of less combustion air than would be required in the absence of such pulsations, said apparatus comprising:

a combustor tube having a predetermined length and having open opposite ends which define acoustic boundary conditions permitting said tube to support natural longitudinal modes of acoustic oscillation; and means defining a continuous combustion zone within said tube for burning fuel and combustion air to generate heat at a particular location which excites a natural longitudinal mode of acoustic oscillation, the particular location being within said tube where the acoustic pressure pulsations lag the acoustic velocity pulsations by approximately one quarter period of the excited mode of acoustic oscillation.

30. An improved combustor apparatus as defined in claim 29 including means for amplifying the amplitudes of said pulsations at said combustion zone by removing heat downstream of said combustion zone within a region wherein both acoustic velocity pulsations and acoustic pressure pulsations occur.

31. An improved combustor apparatus as defined in claim 29 wherein said location of the continuous combustion zone is substantially midway between an upstream location of substantially zero amplitude of acoustic pressure pulsations and a next downstream location of maximum amplitude of acoustic pressure pulsations.

32. An improved combustor apparatus as defined in claim 30 wherein said location of the continuous combustion zone is substantially midway between an upstream location of substantially zero amplitude of acoustic pressure pulsations and a next downstream location of maximum amplitude of acoustic pressure pulsations.

33. An improved combustor apparatus as defined in claim 32 wherein said region of heat removal is located to lie at least at a location substantially midway between an upstream location of maximum acoustic pressure pulsations and a next downstream location of substantially zero acoustic pressure pulsations where the pressure pulsations lead the velocity pulsations.

34. An improved combustor apparatus as defined in claim 30 wherein said region of heat removal is located to lie at least at a location substantially midway between an upstream location of maximum acoustic pressure pulsations and a next downstream location of substantially zero acoustic pressure pulsations where the pressure pulsations lead the velocity pulsations.

35. An improved combustor apparatus for continuously burning fuel while subjecting the burning fuel both to acoustic pressure pulsations and to acoustic velocity pulsations due to acoustic oscillation maintained in the combustor apparatus by virtue of such continuous burning of fuel, said apparatus comprising:

combustor tube means for supporting natural longitudinal modes of acoustic oscillation; and combustion zone means for defining at least one highly localized continuous combustion zone in said combustor tube means to excite acoustic oscillation in said combustor tube means which subjects said combustion zone both to acoustic pressure pulsations and to acoustic velocity pulsations whose amplitudes are significantly greater than zero but are less than their maximum values, said oscillation having at least one acoustic pressure node and at least one acoustic pressure anti-node and said combustion zone means being located approximately half and distance between the acoustic pressure node and the acoustic pressure anti-node where the acoustic pressure oscillation lags the acoustic velocity oscillation by approximately one quarter period of the acoustic oscillation.

* * * * *

UNITED STATES PATENT AND TRADEMARK OFFICE

CERTIFICATE OF CORRECTION

PATENT NO. : 4,529,377

DATED : July 16, 1985

INVENTOR(S) : Zinn et al.

It is certified that error appears in the above-identified patent and that said Letters Patent is hereby corrected as shown below:

Page 1, Abstract, "wavelength" should read --period--.

Figure 1, L = L/4 should read $L_1$ = L/4.

Signed and Sealed this

*Fourth* Day of *February 1986*

[SEAL]

*Attest:*

DONALD J. QUIGG

*Attesting Officer*

*Commissioner of Patents and Trademarks*